United States Patent [19]

Youla

[11] Patent Number: 4,847,728

[45] Date of Patent: Jul. 11, 1989

[54] DETECTING A DEFECTIVE SUPPRESSOR DIODE IN A COIL DRIVING CIRCUIT

[75] Inventor: Jean Youla, Brooklyn, N.Y.

[73] Assignee: Otis Elevator Company, Farmington, Conn.

[21] Appl. No.: 48,163

[22] Filed: May 11, 1987

Related U.S. Application Data

[63] Continuation-in-part of Ser. No. 915,289, Oct. 3, 1986, abandoned.

[51] Int. Cl.[4] ..... H01H 47/00

[52] U.S. Cl. ..... 361/159; 340/815.03; 340/645

[58] Field of Search ..... 361/159; 340/815.03, 340/641, 645

[56] References Cited

U.S. PATENT DOCUMENTS 4,246,621 1/1981 Tsukioka ..... 361/159

4,278,336 7/1981 Ito et al. ..... 361/159 X 4,434,450 2/1984 Gareis ..... 361/159 X 4,670,810 6/1987 Valeur ..... 361/5

FOREIGN PATENT DOCUMENTS 1663155 10/1978 Fed. Rep. of Germany ..... 361/159

*Primary Examiner*—L. T. Hix

*Assistant Examiner*—David M. Gray

[57] ABSTRACT

A driver circuit for the coil in relay contains a suppressor diode across the coil terminals. Two light-emitting diodes are connected in reverse polarity so that one diode operates when the coil is energized and the other diode operates if there is current flowing in the reverse direction when the suppressor diode fails to clamp the coil voltage. The diodes may be of different colors and may be positioned close to each other to produce the composite color when they are energized at the same time or in rapid succession.

13 Claims, 1 Drawing Sheet

DETECTING A DEFECTIVE SUPPRESSOR DIODE IN A COIL DRIVING CIRCUIT

CROSS-REFERENCE TO RELATED APPLICATIONS

This application is a continuation-in-part of application Ser. No. 915,289, filed Oct. 3, 1986, now abandoned, on "Detecting a Defective Suppressor Diode in a Coil Driving Circuit".

TECHNICAL FIELD

This invention relates to techniques for suppressing self-induced voltage spikes in coil driving circuits, and, in particular, detecting a defective suppressor diode, which often is used to suppress those voltage spikes.

BACKGROUND ART

Increasingly, older elevator systems are modernized by retrofitting them with computer-based controls. Older systems frequently use low power relay logic to control elevator operations, such as car dispatching, and other relay controls that control high power operations, for instance, motor and brake operations. Usually, low power relay logic circuits are replaced by a computer during the modernization, but the "power" relays, those that control current to the high power equipment, are retained over far more expensive high power solid switching devices, because power relays are inexpensive, very reliable, and easy to service (i.e., replace) and, therefore, are retained whenever possible.

Following common practice, a suppressor diode is placed across these relay coil terminals to protect the relay drive from high voltage surges when the relay coil is operated. The diode "clamps"—to the diode's forward voltage—the voltage drop across the coil when the current is turned off (when the relay is deenergized). Self induced current, caused by the self-induced voltage from the collapsing coil current flows through the suppressor diode. In older systems, that current was switched on and off by low power control relays, and in those systems, if the suppressor diode opened, the voltage across the coil could be very high (coil voltage=L-(coil inductance) di/dt), perhaps several thousand volts, which would produce arcing across the drive relay contacts to allow the coil current to continue. The resulting very gradual contact wear (pitting) could be spotted easily during periodic maintenance, at which point the suppressor diode would be replaced, perhaps along with the relay or the contacts.

Failure of the suppressor diode, however, can be "lethal" to a solid-state relay driver over time. These drivers often consist of low power solid-state output devices that typically can only tolerate a limited number of modest output over-voltage surges and voltage reversals before the device eventually fails suddenly and completely. Knowing that the suppressor diode has failed can be especially important in servicing an elevator system in which power relays are controlled by a solid-state device, such as a microprocessor with a solid-state relay drive output.

In some related applications, relay operation is monitored by sensing the relay coil voltage to determine the time of activation and deactivation of the relay. For instance, the relay coil terminals may be connected to the input port of a computer that controls sequences based on sensing operation of a relay. These input circuits are also very sensitive to voltage spikes and reversals on the relay coil.

DISCLOSURE OF INVENTION

The present invention is directed at providing a method and apparatus—especially useful in elevator systems—for diagnosing the operation of a relay drive circuit for voltage spikes and reversals.

According to the present invention, a voltage is applied across a relay coil, and this voltage causes a light-emitting device to operate. When the voltage is removed, and if the suppressor diode is open, the voltage reverses, the light-emitting device is turned off and another light-emitting device is turned on.

According to one aspect of the invention, the light-emitting devices are positioned close to each other so that they produce a composite illumination if both are energized simultaneously or in rapid succession. Each device gives off a different color; the composite appears as a third color, indicating a voltage reversal.

According to another aspect of the invention, current flows in one direction (from the relay coil to a voltage sensor) through one light-emitting device which then illuminates and in the opposite direction through the other light-emitting device which is then illuminated.

BEST MODE FOR CARRYING OUT THE INVENTION

Figure 1:
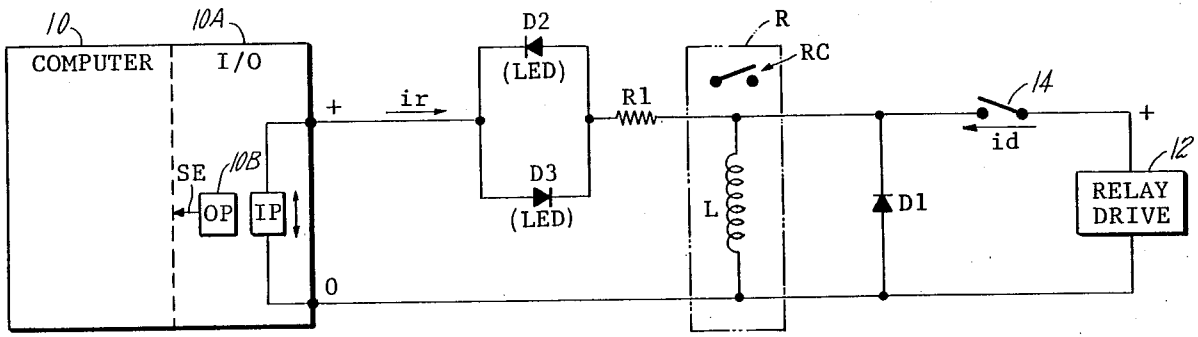
FIG. 1 is a schematic showing one embodiment of the invention; in the embodiment, the light-emitting devices provide a visual indication of suppressor diode condition from current that flows through an input device, which is in the input/output port on a computer to provide to the computer a signal indicating relay operation.

Computers and computer peripherals are widely known and well understood, and for that reason details of a computer control for driving a relay coil are not shown in any great detail in the drawing. In the drawing, a computer 10 is shown which includes an input-/output (I/O) port 10A. In reality, this input/output port would include a plurality of terminals connected to a host of different devices, some for driving an output device, such as a relay, in response to a signal from the computer, others for receiving an input voltage, for instance, from the terminals of a relay coil, to provide a signal to the computer. In an elevator system, the I/O would be connected to many relays; one is shown in each figure for simplicity.

In the particular application of the invention shown in FIG. 1, the input/output port 10A is connected to a one coil L, which is part of a relay R consisting of the coil and movable contact RC. Current is applied to the coil to close the contact RC. A suppressor diode D1 is connected across to terminals of the coil L. A switch 14 is closed to provide D.C. current from a relay drive 12 to one terminal of the coil L. For the purposes of discussion, the switch 12 voltage is assumed to be positive (+) relative to ground (0) when the switch (14) is closed, at which point the relay is energized by the relay drive current id.

The voltage across the coil L also causes parallel current flow from the positive coil to ground through a load resistor R1, a light-emitting diode (LED) D2 and the input section IP of a bidirectional coupler 10B, such as an opto-isolator that is in the I/O port 10A. The diode D2 is connected in reverse polarity (back to back) with another LED D3. The current in the input section IP causes the output section OP to produce a signal SE for the computer; signal SE indicates that the relay is activated (energized). The current causes the LED D2 to illuminate. When the switch 14 is opened, to turn the relay off, the coil drive current id is stopped and the coil produces a reverse voltage that is clamped to the forward voltage drop of the suppressor diode D1, somewhere about 0.6 to 0.8 volts. If the suppressor diode has failed, in that it is "open", the coil voltage will rise (the coil terminal 0 goes positive relative to the +terminal) to the point at which LED D3 will conduct, causing it to illuminate. LED D2 will stop illuminating when the switch 14 is opened. The current now through the input section IP will be in the opposite direction (current ir). The consequent illumination of diode D3 indicates that the suppressor diode has failed.

The current within the loop consisting of the coil L and the input/output terminal may be A.C. due to some "ringing current". This would be more likely to arise if the coil inductance is high. Both of the diodes will be energized in sequence, but this will not be observable (especially not at a distance) because of the slow response time of the LEDs (the time it takes for them to turn on and off). Assuming the LEDs are red and green, the appearance of the two LEDs together, i.e., they are side by side, will seem yellowish, that being the combination or composite of red and green that the LEDs would produce if turned on simultaneously. The effect, however, is the same because of the slow response time of these LEDs to the current swings, even though they are actually turned on in sequence (because the voltage swings reverse the current polarity).

Figure 2:
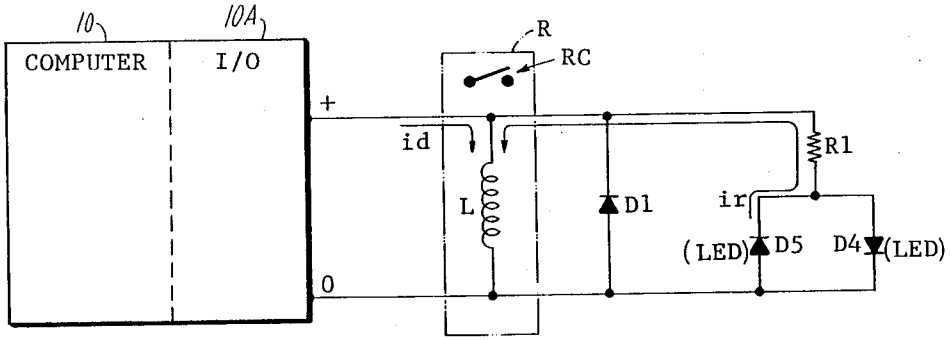
FIG. 2 is a schematic showing a second embodiment; in this embodiment the visual indication is provided by the change in voltage across relay coil terminals when the relay is turned on and off by a computer.

The embodiment shown in FIG. 2, which shows a "relay driving system" in place of the "relay sensing system" shown in FIG. 1, also uses two differently colored LED's (a diode pair), LED D4 (e.g., green) and LED D5 (e.g., red). In this circuit, they are in series with a current limiting resistor R1 that is between the coil terminals, forming a circuit through which current may flow between the coil terminals - if the suppressor diode opens. In this embodiment, the I/O 10A provides drive current id to the coil L. If the suppressor diode D1 has failed, the LEDs D4 and D5 allow current to "ring" around a loop consisting of the coil, the LEDs and the resistor R1. When the relay coil is energized, current id (again, the relay drive current) flows through LED D4 and the resistor R1, causing the LED D4 to illuminate. When the current id is stopped, the current will continue to flow, but now through LED D5 as the reverse current ir of the same magnitude as the current id when the current id was stopped, causing that LED D5 to illuminate. At this point, the coil has become a current source, the terminal at ground going positive, in the process turning off LED D4 and turning on LED D5. If the two LEDs D4 and D5 are close to each other, e.g., side by side, they will appear to produce a composite illumination, as described previously.

A light-emitting diode suitable for these applications that is commercially available and which contains two red and green LEDs in virtually a single package is made by General Instrument, under the model designation MV-5491. This pair of diodes is contained in a very small container that includes a diffuser lens, which, though intended to increase the viewing angle of each of the diodes, actually helps in producing the "composite" color described previously.

The model MV-5491 can be easily installed in an existing relay driving system, for instance on the same circuit board that contains the computer, so that operation of the diodes can be easily observed. In an elevator system, for example, a service technician may install it in one of the drive lines to the relay L by opening the controlling wire and connecting it in series. An array of diodes would be seen on the circuit board, one pair for each relay connected to the board.

In order to determine whether the suppressor diode is operating, the coil L is energized, which will be shown by the illumination of diode D2 (in FIG. 1) and diode D4 (in FIG. 2). When the diode then goes off, when the drive turns off, the other LED in the circuit should not illuminate. Illumination of that LED or, more likely, the appearance of the composite color of the two LEDs will demonstrate that there is reverse current, which can only happen if the suppressor diode is open. A particular appeal of this invention is that an elevator system may be easily rewired so that there is a bank of LEDs in place on an easily viewable circuit board in the machine room. Then, the relays may be sequenced and the diode illumination observed as "flashing lights". In fact, it is possible to put the elevator through normal or service operation and simply observe the LEDs go on and go off as the relays are sequenced on and off. A flashing yellow light among the green indicates that a suppressor diode is open in a relay drive circuit. The procedure may be done very conveniently during a normal service. In the alternative, it is possible in other applications to put the LED's and the current limiting resistor temporarily in circuit with the coil as shown in order to detect the presence of a defective suppressor diode.

The above discussion may enable one skilled in the art to develop functionally equivalent modifications and variations to the invention as a whole or the parts thereof as disclosed herein without departing from the invention's true scope and spirit.

I claim:

1. In combination, a coil, coil driving means, coupling means for allowing current flow between the coil terminals, to provide a signal when the coil is energized by the coil driving means, and a first light-emitting device that emits light only in response to the current between the coupling means and the coil in a first direction;

a second light-emitting device connected in parallel with the first light-emitting device and that only emits light in response to current flow between the coupling means and the coil in a second direction that is the reverse of said first direction; and a diode across the coil terminals for limiting the voltage across the coil to a voltage insufficient to permit current flow in said second direction through said second light-emitting device.

2. A combination according to claim 1, characterized in that each light-emitting device comprises a light-emitting diode, and said light-emitting diodes are connected in parallel with the anode of one diode connected to the cathode of the other diode.

3. A combination according to claim 1, characterized in that the diodes are of different colors.

4. A combination according to claims 1 or 3, characterized in that the two light-emitting devices are positioned next to each other so they can produce a composite illumination if both devices illuminate simultaneously.

5. A method of observing a coil current control in which the coil voltage, when coil current is turned on and off, is used to operate coupling means to provide a signal that the coil is energized, there being means for limiting the coil voltage to less than a threshold level when the coil is turned off, characterized by the steps:

placing in series between one terminal of the coil and one terminal of the coupling means a light-emitting device that emits light when the current flows in one direction between those terminals;

placing in parallel with the first light-emitting device a second light-emitting device that only emits light if the current flows opposite the first direction between those terminals when the coil voltage exceeds the threshold level;

energizing the coil;

deenergizing the coil; and observing light output from the first and second light-emitting devices.

6. A method according to claim 5, characterized in that the first and second light-emitting devices comprise light-emitting diodes that are reverse polarity connected in parallel in series with one terminal of the coupling and one terminal of the coil.

7. In combination, a coil with two coil terminals and coil driver for providing current in a first direction through the coil, the combination characterized by:

first means in parallel electrical connection with the coil for emitting light when said current is applied to the coil;

second means in parallel electrical connection with the coil for emitting light when the voltage across the coil reverses when said current is stopped and when said voltage rises above a threshold, and third means in parallel electrical connection with the coil for limiting the voltage across the coil to a voltage below said threshold.

8. A combination according to claim 7, characterized in that:

the first and second means comprise light-emitting diodes connected in parallel reverse polarity to each other and said diodes are in series with a current limiting resistor to form a circuit connecting the two coil terminals.

9. A combination according to claim 8, characterized in that the two light-emitting diodes are of different colors.

10. A combination according to claims 7 or 9, characterized in that the first and second light-emitting devices are located so that they can produce a composite illumination if both illuminate simultaneously.

11. A method for observing a coil control in which a coil driver powers a coil and coil suppression means limits the voltage across the coil to a level below a threshold, characterized by the steps:

connecting in circuit between the coil terminals first means for providing light when the coil is energized;

connecting in circuit between the coil terminals second means for providing light when the coil voltage reverses and exceeds said threshold;

activating the coil driver;

deactivating the coil driver; and observing light output from the first and second means.

12. A method according to claim 11, characterized in that:

the first and second means are light-emitting diodes of different colors.

13. A method according to claims 11 or 12, characterized in that the first and second means are located close to each other to produce composite illumination when both means illuminate simultaneously.

* * * * *